US005476170A

United States Patent [19]

Weber

[11] Patent Number: 5,476,170

[45] Date of Patent: Dec. 19, 1995

[54] BOTTLE CARRIER HAVING IMPROVED GRIPPING MEANS

[75] Inventor: Claudia Weber, São Paulo, Brazil

[73] Assignee: The Mead Corporation, Dayton, Ohio

[21] Appl. No.: 259,401

[22] Filed: Jun. 13, 1994

[51] Int. Cl.[6] ..... B65D 75/00; B65D 71/00

[52] U.S. Cl. ..... 206/147; 206/153; 206/159

[58] Field of Search ..... 206/145, 147, 206/153, 148, 149, 151, 156, 159, 161, 427; 294/87.2

[56] References Cited

U.S. PATENT DOCUMENTS

| | | | |
|---|---|---|---|
| 2,764,284 | 9/1956 | Arneson | 206/147 |
| 2,823,062 | 2/1958 | Toensmeier | 294/87.2 |
| 2,823,063 | 2/1958 | Toensmeier | 294/87.2 |
| 3,528,697 | 9/1970 | Wood | 294/87.2 |
| 3,640,563 | 2/1972 | Wood | 206/145 X |
| 3,834,750 | 9/1974 | Gauntlett | 206/148 X |
| 4,180,191 | 12/1979 | Wood | 294/87.2 |
| 4,318,476 | 3/1982 | Wood et al. | 206/459.5 |
| 4,621,734 | 11/1986 | Heijnen et al. | 206/427 |
| 5,273,156 | 12/1993 | Harris | 206/147 |

FOREIGN PATENT DOCUMENTS

| | | |
|---|---|---|
| 0170259 | 2/1986 | European Pat. Off. . |
| 1423952 | 11/1965 | France . |
| 1286211 | 8/1972 | United Kingdom . |

*Primary Examiner*—Jacob K. Ackun
*Attorney, Agent, or Firm*—Tsugihiko Suzuki

[57] ABSTRACT

A bottle carrier includes a tubular structure including a base wall and a top portion disposed above the base wall, neck-gripping edges provided for the top portion to engage the underside of a peripheral neck projection of a bottle, and shoulder-gripping flaps provided for the base wall to engage and press down on the shoulder of the bottle. The top portion of the tubular structure has an upper aperture for receiving the neck of the bottle whereas the base wall has a lower aperture for receiving the shoulder of the bottle. The upper and lower apertures are disposed in vertical alignment with each other. Due to the shoulder-gripping flaps, the carrier is urged upward even when in a displayed condition, and thereby the neck-gripping edges are pressed against and kept in firm engagement with the underside of the peripheral projection without vertical play.

9 Claims, 10 Drawing Sheets

BOTTLE CARRIER HAVING IMPROVED GRIPPING MEANS

BACKGROUND OF THE INVENTION

This invention relates generally to a top-gripping bottle carrier for engaging bottles at the bottle necks, and more particularly to such a bottle carrier having tight gripping means which is especially adapted for bottles with small-sized neck flanges or even with no neck flanges but caps. The invention also relates to a bottle package formed using the carrier.

U.S. Pat. No. 4,180,191 which is owned by the assignee of this invention discloses a top-engaging bottle carrier designed to engage bottle neck flanges. According to the patent, the side walls of the carrier are provided with an upper aperture for receiving the neck flange of a bottle. The peripheral edge of the upper aperture serves as bottle neck-gripping means for supporting the flange at its diametrically opposed portions. The side walls are interconnected at their lower edges by a base wall having a lower aperture for receiving the lower neck portion or shoulder of the bottle. The lower aperture is properly dimensioned such that the diameter of the lower aperture is slightly larger than that of the portion of the bottle received in the lower aperture. This is because a tight lower aperture would hinder smooth insertion of the bottle neck into the upper aperture and also because it would cause undue warp or creases in the side walls of the carrier which would detract from the appearance of the carrier.

A large-sized lower aperture is not without disadvantages, however. Such a lower aperture would provide play to the bottle received therein and would allow undue movement of the bottle and the carrier with respect to each other. For example, jiggling of the bottles in the carrier while the bottles are transported by holding the carrier would give a sense of insecurity to users. Such jiggling is particularly not desirable when the carrier is required to engage the bottles at their small-sized flanges or their bottle caps. These small-sized neck flanges or the bottle caps radially project less than about 1/10 inch from the respective bottle neck surface whereas the regular neck flanges project normally about 1/5 inch. Due to their relatively small radial dimension, the small-sized flanges and the bottle caps are more susceptible to disengagement from the neck-gripping means than regular neck flanges.

What is needed, therefore, is a top-engaging carrier which smoothly receives bottles without causing undesired warp or creases in the side walls and is yet capable of inhibiting undue movement of the bottles with respect to the carrier.

SUMMARY OF THE INVENTION

In meeting the foregoing needs, the present invention provides a package which accommodates one or more bottles. Each bottle used in the invention includes a tapered shoulder and a neck having a peripheral projection disposed therearound.

The bottle or bottles are engaged by a bottle carrier of a top-gripping type, which carrier comprises a tubular structure including a base wall and a top portion disposed above the base wall, neck-gripping means provided for the top portion of the tubular structure to engage the underside of the peripheral projection of the bottle, and shoulder-gripping means provided for the base wall of the tubular structure to engage and press down on the shoulder of the bottle. The top portion of the tubular structure has a first or upper aperture for receiving the neck of the bottle whereas the base wall has a second or lower aperture for receiving the shoulder of the bottle. The first and second apertures are disposed in vertical alignment with each other. Due to the shoulder-gripping means, the carrier is urged upward even when in a displayed condition, and thereby the neck-gripping means is pressed against and kept in firm engagement with the underside of the peripheral projection without vertical play.

In a preferred embodiment, the shoulder-gripping means is a pair of opposing gripping flaps struck from the base wall. Such gripping flaps define the second aperture in the base wall. Both the gripping flaps are joined to the base wall. In particular, at least one of the gripping flaps is joined to the base wall along a substantially arched fold line which lies concave to the other gripping flap. In an alternative embodiment, at least one of the gripping flaps is joined to the base wall along a pair of divergent fold lines which extend divergently from each other toward the other gripping flap. The gripping flaps are thrust aside and folded inwardly of the tubular structure by the bottle and thereby press down on the bottle shoulder in response to the inward fold action thereof.

A preferred embodiment of the peripheral projection of the bottle is a neck flange such as commonly found on a PET bottle. Another preferred embodiment of the peripheral projection is a bottle cap.

According to an alternate definition, the invention may provide a bottle carrier for engaging and supporting a bottle at its bottle neck. Such a carrier comprises a base wall and a pair of inwardly sloping side walls upstanding respectively from opposite side edges of the base wall to form a tubular structure, gripping means for gripping a bottle neck at under a neck flange thereof, and tightening means. The sloping side walls are foldably joined at its upper edges together along a ridge extending parallel to the tube axis of the tubular structure. The gripping means is a pair of engaging edges defining in the side walls a first or upper aperture for receiving the neck flange. The engaging edges are provided respectively by the side walls, opposed transversely of the tube axis and extend substantially parallel to the tube axis. The tightening means tightens the engaging edges on the bottle neck. The tightening means includes a pair of opposing flaps struck from the base wall and defining in the base wall a second or lower aperture for receiving the lower neck portion of the bottle and a pair of triangular panel portions. At least one of the flaps is joined to the base wall along a pair of divergent fold lines which extend divergently from each other toward the other flap. Each triangular panel portion connects between the associated gripping flap and the adjacent side wall of the carrier. Each portion is formed from the base wall and defined by the lower edge of the adjacent side wall and the adjacent divergent fold line. The triangular panel portions are inclined outwardly of the tubular structure when the flaps are folded inwardly of the tubular structure along the divergent fold lines. Because the triangular panel portions are inclined, the side walls of the carrier are swung toward each other about the ridge of the tubular structure so that the engaging edges are forced toward each other to be tightened on the bottle neck.

Due to the tight structure or the improved gripping ability of the carrier of the invention, the carrier and the bottles in the carrier are stabilized against undue movement with respect to each other. Application of the carrier of the invention onto a bottle is smoothly achieved because the bottle neck is guided into the first aperture by the flaps. According to the invention, stress is primarily induced in the base wall and the flaps which are disposed inside the carrier when folded. Therefore, even if warp or creases are created in these portions, they are not obvious from the users' view points. The carrier of the invention is especially suitable for engaging bottles having small-sized neck flanges.

The invention further provides a top-gripping bottle carrier which includes a base wall having a bottle neck-receiving aperture and a pair of side walls upstanding respectively from opposite side edges of the base wall. The side walls are foldably joined at their lower edges to the base wall and are provided respectively with hand apertures. Each hand aperture is disposed astride the lower edge of the respective side wall and extends into the base wall. This carrier further includes means for downwardly displacing a part of the base wall relative to the side walls in response to introduction of a bottle neck into the neck-receiving aperture such that the vertical size of each hand aperture is increased to provide additional hand room.

Such displacing means may be a flap struck from the base wall and defining the neck-receiving aperture. The flap is foldably joined along its opposite side edges respectively to a pair of triangular panel portions of the base wall. The triangular panel portions are foldably joined respectively to the side walls and define respective edges of the hand apertures.

Other advantages and objects of the present invention will be apparent from the following description, the accompanying drawings, and the appended claims.

DETAILED DESCRIPTION OF THE PREFERRED EMBODIMENT

Figure 1:
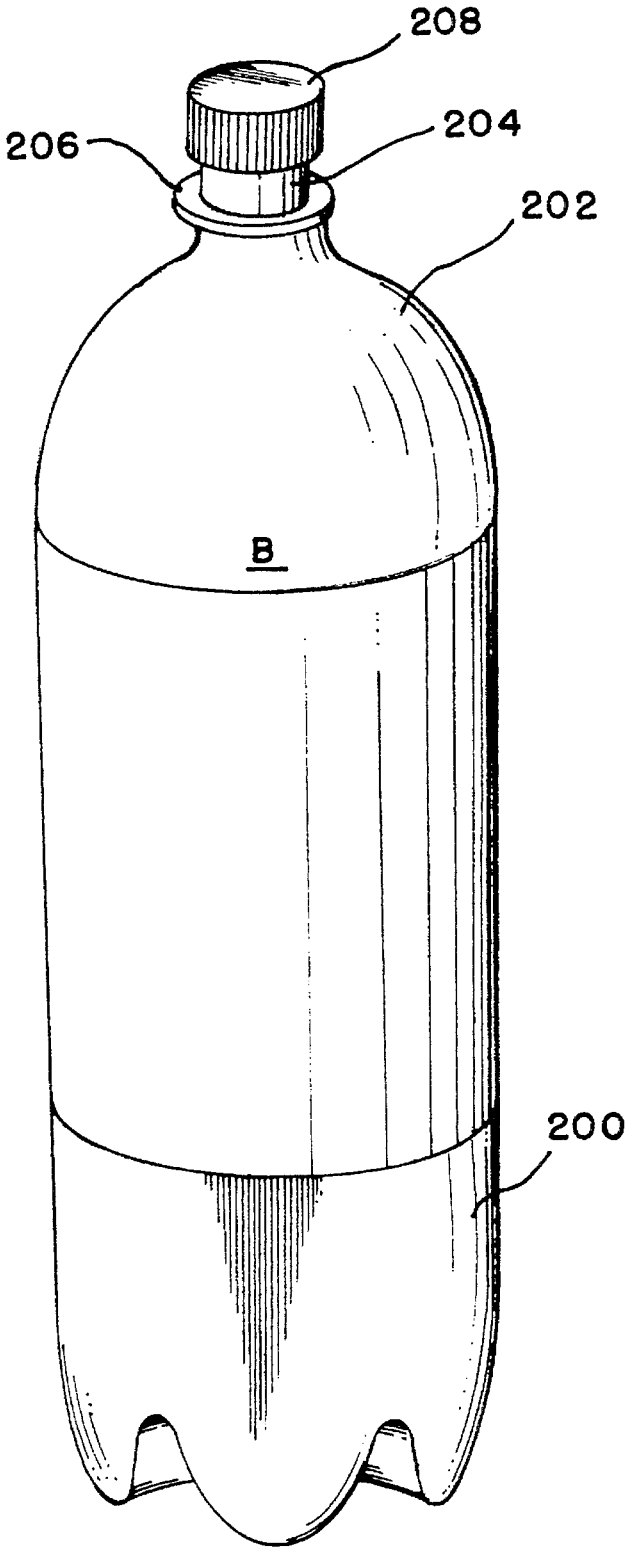
FIG. 1 is a perspective view of a bottle used in the invention.

The present invention is intended primarily for use with bottles of the type used in containing mineral water and soft drinks such as soda, fruit juice and the like. A typical example of such a bottle is a PET bottle including a generally cylindrical body with a bottom, a tapering shoulder smoothly continuous with the upper portion of the body, a neck formed on the shoulder and having a smaller diameter than the body, a neck flange formed around and projecting outwardly from the neck, and a cap attached to the upper end of the neck. An example of such a bottle is shown in FIG. 1 wherein the body, the shoulder, the neck, the flange and the cap are designated by the numerals 200, 202, 204, 206 and 208 respectively.

Figure 2:
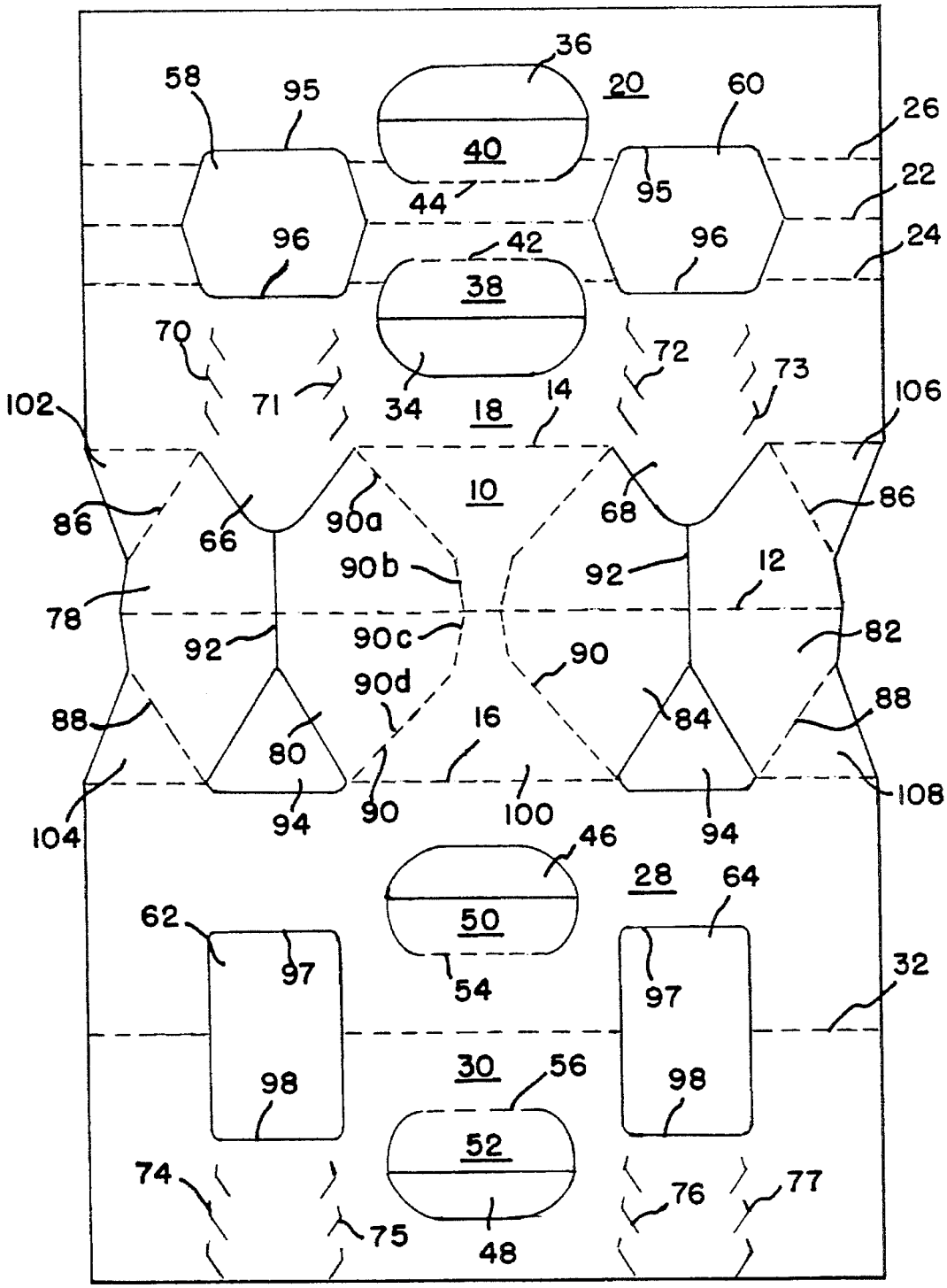
FIG. 2 is a plan view of a blank from which a carrier according to the invention is formed.

According to the invention, the bottles described above are packaged in a carrier which is illustrated in blank form in FIG. 2. The blank is formed from a foldable sheet material such as paperboard, plastic sheet or the like. Reference numeral 10 designates a base wall having a medial fold line 12 extending along the length thereof and side edges defined by interrupted fold lines 14 and 16 parallel to the medial fold line 12. An inner side panel 18 is foldably joined to the base wall 10 along the interrupted fold line 14, and another inner side panel 20 is foldably joined to the inner side panel 18 along an interrupted medial fold line 22. The inner side panels 18 and 20 are provided with interrupted bend lines 24 and 26. In like manner, an outer side panel 28 is foldably joined to the base wall 10 along the interrupted fold line 16, and another outer side panel 30 is foldably joined to the outer side panel 28 along an interrupted medial fold line 32.

Hand apertures 34 and 36 are formed respectively in the inner side panels 18 and 20 for the purpose of holding the carrier. Hand cushioning gripping flaps 38 and 40 are foldably joined to the inner side panels 18 and 20 along fold lines 42 and 44, respectively. Also, hand apertures 46 and 48 are formed in the outer side panels 28 and 30 respectively and are provided with cushioning gripping flaps 50 and 52 which are foldably joined to the outer side panels 28 and 30 along fold lines 54 and 56, respectively.

For the purpose of receiving and retaining the neck of the packaged bottles, first apertures or upper apertures are provided. More specifically, apertures 58 and 60 are formed in the inner side panels 18 and 20 and are disposed astride the medial fold line 22. In like manner, apertures 62 and 64 are formed in the outer side panels 28 and 30 and are disposed astride the medial fold line 32. When the blank is assembled into a carrier, the apertures 58 and 60 are disposed in vertical alignment respectively with the apertures 62 and 64, and thereby constitute the first apertures.

Reference numerals 66 and 68 denote pull tabs which are provided for the purpose of rendering removal of the bottles from the carrier feasible. The details of these tabs 66 and 68 and their associated severance lines 70–77 are disclosed, for example, in U.S. Pat. No. 4,180,191 which is hereby incorporated by reference.

According to a feature of the invention, the base wall 10 is provided with two pairs of gripping flaps 78, 80, 82 and 84 struck therefrom. Each pair of gripping flaps are provided to be associated with one bottle as will be described later, and therefore the carrier to be formed from the blank in FIG. 2 is of two-bottle capacity.

The gripping flap 78 of one of the pairs is foldably joined to the base wall 10 along divergent fold lines 86 and 88 whereas the gripping flap 80 is foldably joined to the base wall 10 along a substantially arched fold line 90 which lies concave to the gripping flap 78. The fold lines 86 and 88 extend from one of the opposite end edges of the base wall 10 to the adjacent side edges of the base wall 10 respectively so as to diverge from each other in the direction toward the gripping flap 80. The arched fold line 90 is disposed essentially transversely of the medial fold line 12, and the opposite ends of the fold line 90 lies on the fold lines 14 and 16. The gripping flaps 78 and 80 extend from their respective fold lines to respective free end edges which are defined by a common slit 92. The opposite side edges of each of the gripping flaps 78 and 80 are severed from the adjacent portions of the carrier so as to be free of restriction. The arched fold line 90 in FIG. 2 is illustrated as an angled line consisting of a plurality of linear fold line elements 90*a*, 90*b*, 90*c* and 90*d* angularly disposed with each other and connected in an end-to-end relationship. However, it may be a smoothly curved line, instead. The gripping flaps 78 and 80 in cooperation define a second or lower aperture 94 in the base wall 10 when folded out of the plane of the base wall 10 along the respective fold lines 86, 88 and 90. The second aperture 94 is designed to receive the shoulder 202 of an associated bottle, and the maximum diameter of the second aperture is greater than that of the portion of the bottle shoulder to be received in the second aperture.

The gripping flaps 82 and 84 are virtually identical respectively to the gripping flaps 78 and 80, and therefore description of the gripping flaps 82 and 84 and their associated portions is omitted. Those associated portions of the gripping flaps 82 and 84 are designated by same references as used for the portions associated with the gripping flaps 78 and 80.

Figure 3:
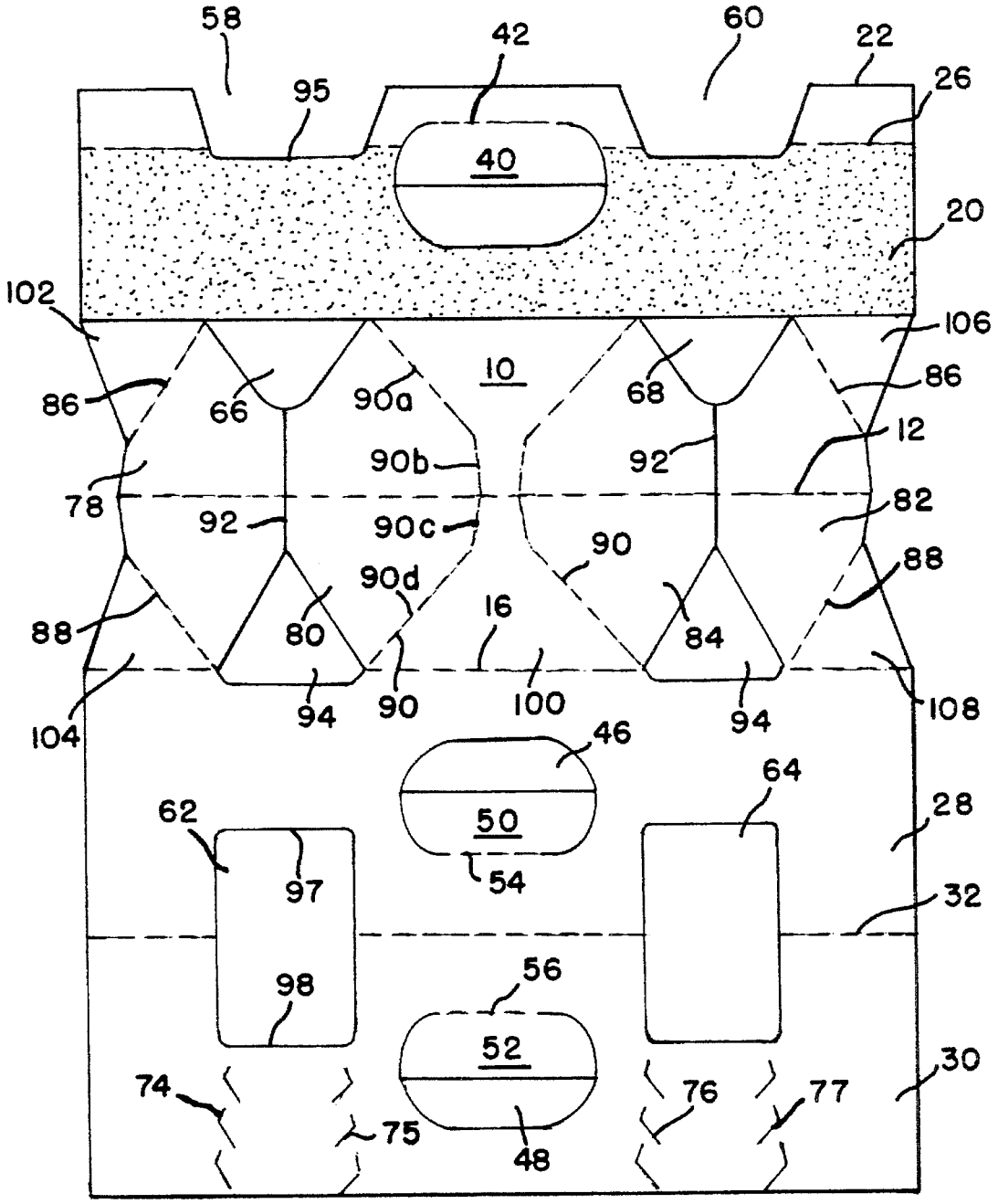
FIGS. 3–4 are plan views illustrating how to form a carrier from the blank in FIG. 2.
Figure 4:
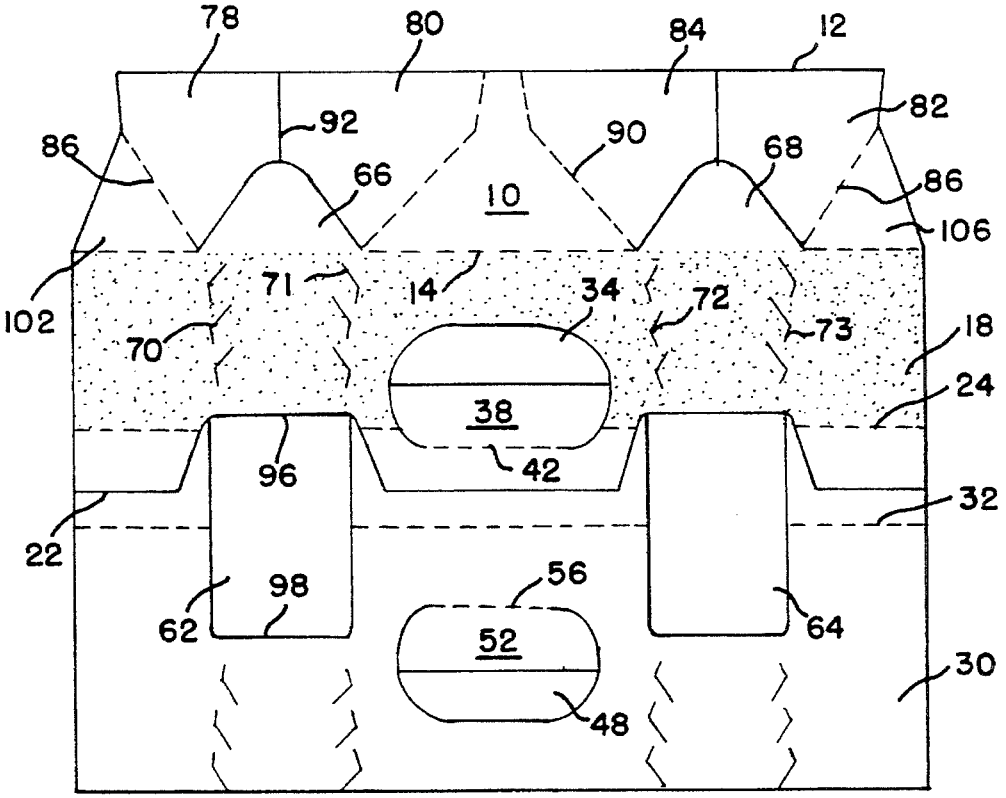
Figure 5:
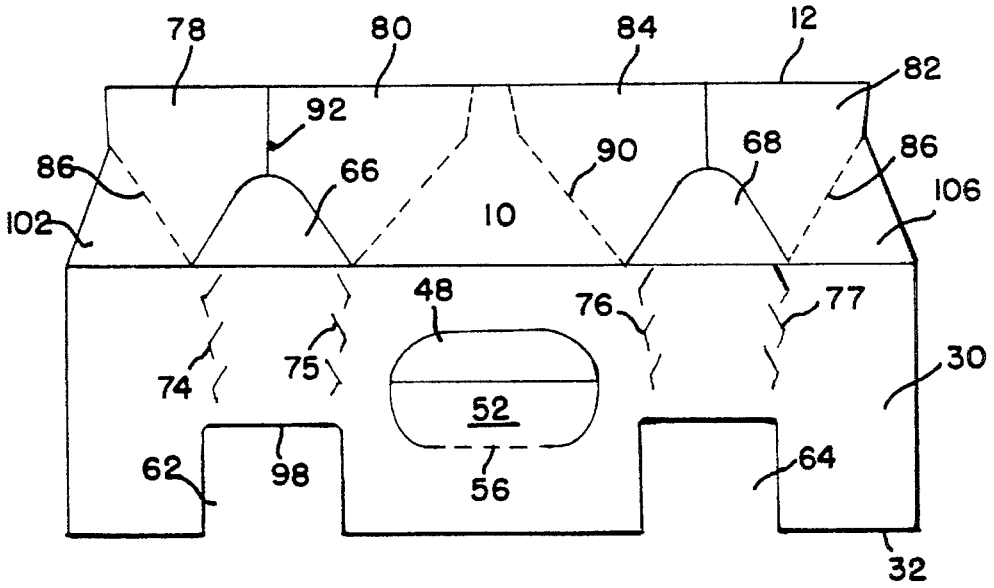
FIG. 5 is a plan view of the carrier in a flat, completed condition.

In order to form the carrier from the blank shown in FIG. 2, initially the inner side panel 20 is folded along medial fold line 22 over the inner side panel 18 to occupy the position shown in FIG. 3. Thereafter an application of glue is made to the exposed portion of the inner side panel 20 disposed between the interrupted bend line 26 and the lower side edge thereof as shown by stippling in FIG. 3. After that, the elements of the blank disposed above the medial fold line 12 are folded over to occupy the position shown in FIG. 4 and the inner side panel 20 is adhered to the outer side panel 28. Then, an application of glue is made to the exposed portion of the inner side panel 18 between the interrupted bend line 24 and the fold line 14 as shown by stippling in FIG. 4. Following this operation, the outer side panel 30 is folded along the fold line 32 to overlie the inner side panel 18 as shown in FIG. 5. By this means, the inner side panel 18 is adhered to the outer side panel 30. The carrier as illustrated in FIG. 5 is in its completed and collapsed condition wherein the inner side panel 18 and outer side panel 30 form a composite side wall, and the inner side wall and 20 and the outer side wall 28 form another composite side wall.

Figure 6:
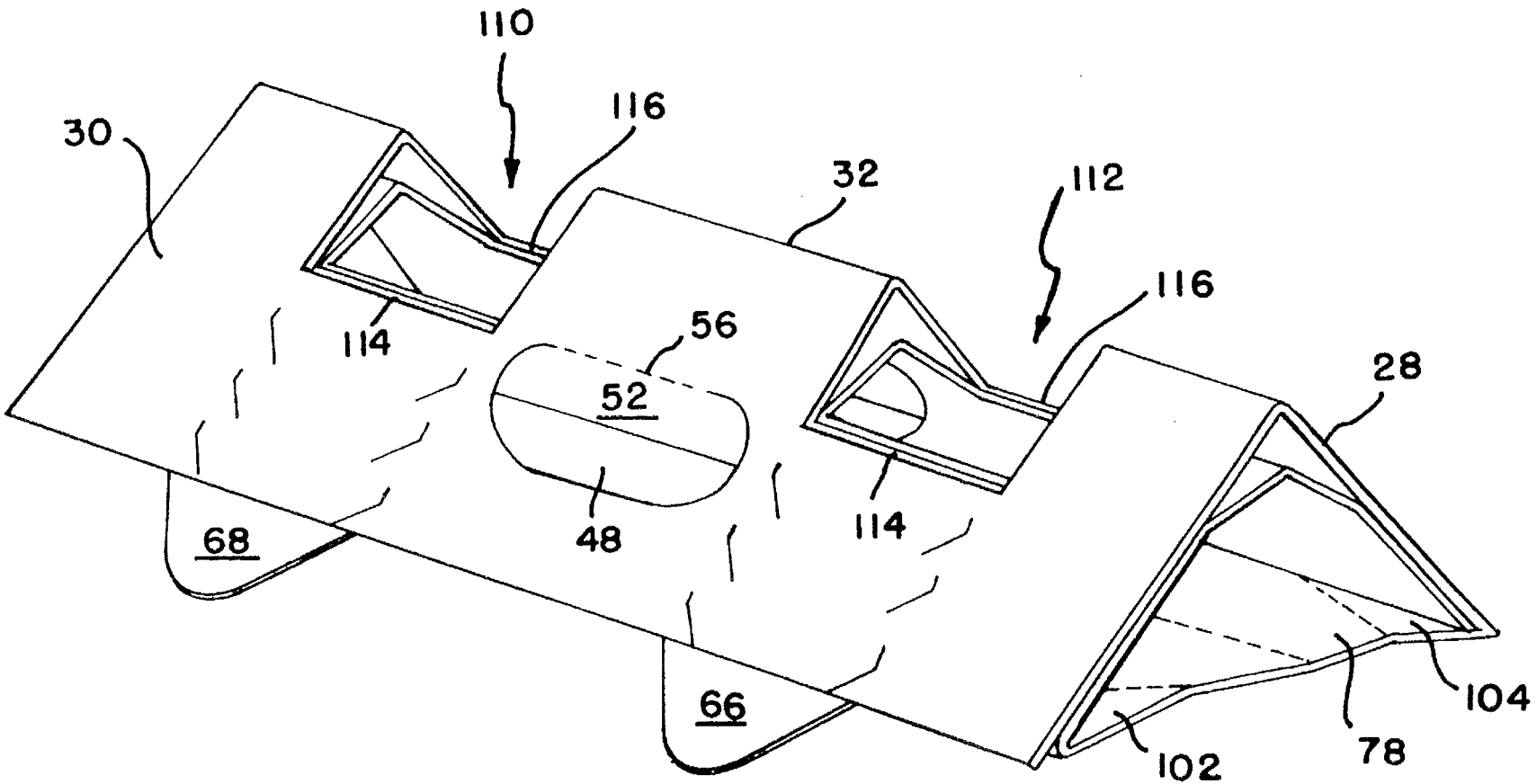
FIG. 6 is a perspective view of the carrier in a set up condition.

In order to set up the carrier from the condition shown in FIG. 5, it is simply necessary to fold the base wall 10 into a flat plane. As this occur, the pair of side walls of the carrier are automatically moved apart, which results in formation of a carrier in a tubular, three-dimensional condition, having a triangular cross section as shown in FIG. 6. In this tubular condition, the apertures 58 and 60 in the inner side panels 18 and 20 are disposed in vertical alignment with the apertures 62 and 64 in the outer side panels 28 and 30 and create the aforementioned upper apertures which are designated at 110 and 112 in FIG. 6. The longitudinally extending opposing edges 97 and 98 of each aperture in the outer side panels 28 and 30 are generally coincidentally disposed respectively on the longitudinally extending opposing edges 95 and 96 of the respective aperture in the inner side walls 20 and 30, and thereby a pair of opposing double wall edges 114 and 116 are formed for each upper aperture to serve as a first neck-gripping means.

To have the tubular carrier engaged with the bottles to be packaged, it is simply necessary to lower the carrier onto the bottles arranged in a row. As the carrier is lowered, the bottles are introduced into the respective lower apertures 94 in the base wall 10 and thrust the respective pairs of gripping flaps upward against their resistance. This folds the gripping flaps 78, 80, 82 and 84 upwardly, or inwardly of the tubular carrier, about their respective fold lines 86, 88 and 90, and at the same time bows the gripping flaps 78, 80, 82 and 84 so that they assume arcuate outlines due to their arched and divergent fold lines 86, 88 and 90, which outlines generally conform to the respective tapered surfaces of the bottle shoulders.

Figure 7:
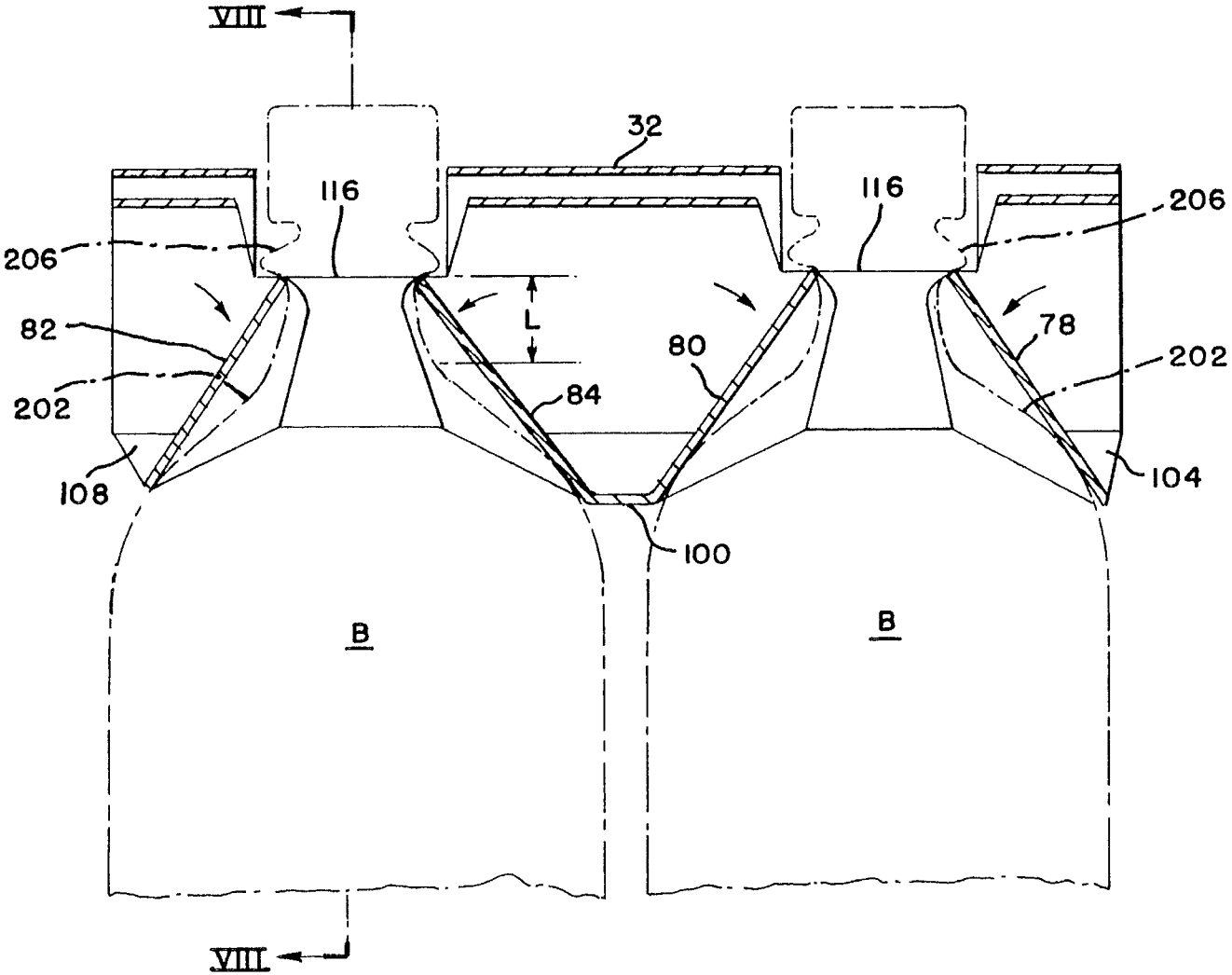
FIG. 7 is a schematic longitudinal or axial cross sectional view of the carrier in FIG. 6, showing the condition wherein gripping flaps at the base wall being folded inwardly of the carrier.
Figure 8:
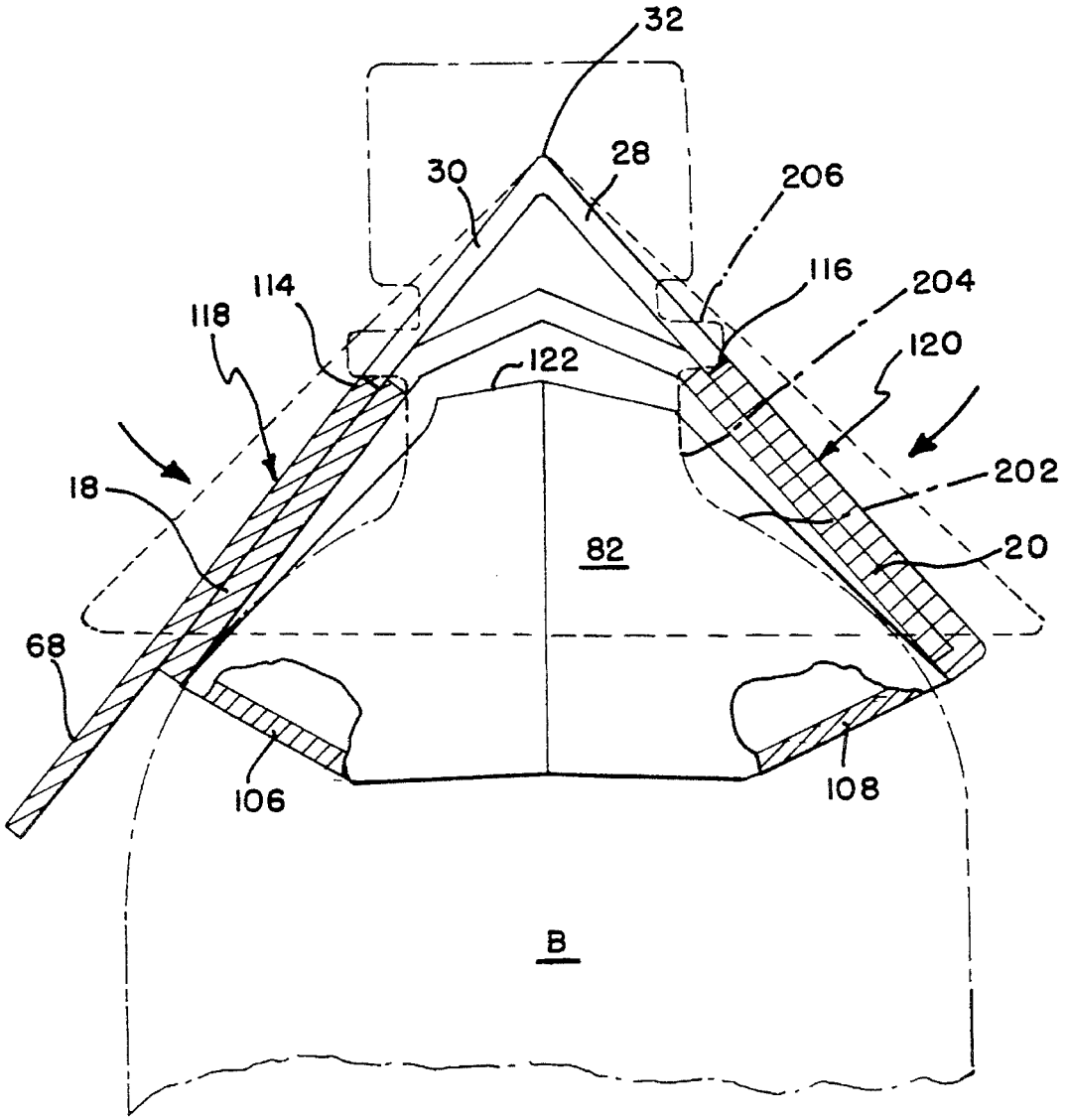
FIG. 8 is a view taken along the line VIII—VIII in FIG. 7.
Figure 9:
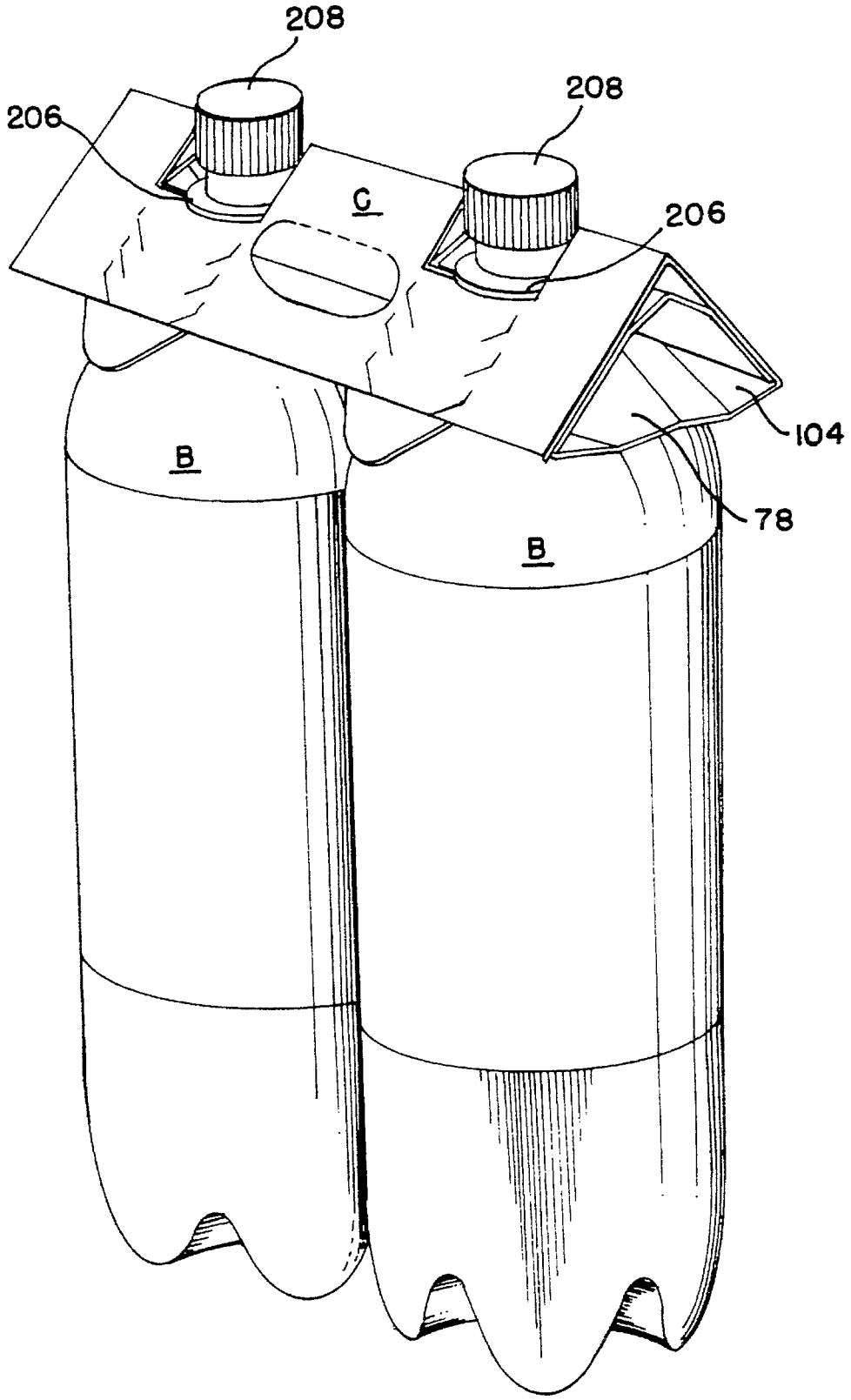
FIG. 9 is a perspective view of a bottle package formed using the carrier in FIG. 6.

As the bottles further progress into the apertures 94, the neck flanges 206 clear the free end edges of the gripping flaps 78, 80, 82 and 84 which, in turn, snap radially inwardly into the positions underneath the bottle neck flanges 206. This is best shown in FIG. 7. At the same time, the bowed gripping flaps 78, 80, 82 and 84 spring downwardly and radially inwardly into snug embracing engagement with the tapered surfaces of the bottle shoulders 202. Following this, the bottle neck flanges 206 reach the positions inside the respective upper apertures 110 and 112 whereupon the opposing edges 114 and 116 of the upper apertures 110 and 112 snap radially inwardly into the positions underneath the neck flanges 206 and tightly and firmly grip their associated bottle necks 204 (see FIG. 8). A two-bottle package is thus completed which is illustrated in FIG. 9 wherein the bottles B are fully engaged by the carrier C.

The firm or tight grip of the carrier on the bottle necks owes to the divergent and arched fold lines 86, 88 and 90. When the gripping flaps 78, 80, 82 and 84 are folded upwardly along the fold lines 86, 88 and 90, the portion 100 of the base wall 10 between the arched fold lines 90 are bowed downwardly as shown in FIG. 7 and the triangular portions 102, 104, 106 and 108 of the base wall 10 are inclined downwardly as shown in FIGS. 7 and 8 (only 104, 106 and 108 shown). This reduces the distance between the lower edges of the side walls 118 and 120 (see FIG. 8) of the carrier and, in fact, causes the side walls 118 and 120 to swing in the direction of the arrows in FIG. 8 from the original positions shown by the broken line in FIG. 8. As a result, the opposing edges 114 and 116 of each upper aperture are forced or moved toward each other to be tightened and have firm grip on the respective bottle necks.

The firm grip on the bottle necks is assisted by the gripping flaps themselves. Because the gripping flaps 78, 80, 82 and 84 and the portion 100 of the base wall 10 are bowed, stress is induced in the sheet material of the carrier to bias the gripping flaps in the direction of the arrows in FIG. 7. This causes the gripping flaps 78, 80, 82 and 84 to press down on the bottle shoulders 202, and as a result the entire carrier including the side walls 118 and 120 is urged upward. This, in other words, means that the opposing edges 114 and 116 are pressed against the undersides of the bottle flanges 206, which eliminates vertical play of the carrier and assists in stable and firm grip of the opposing edges 114 and 116 on the bottle necks. Great pressing force is available when the gripping flaps 78, 80, 82 and 84 and the portion 100 of the base wall 10 are bowed within the limit of elasticity of the sheet material of the carrier.

Grip on the bottles provided by the carrier becomes more reliable when the gripping flaps 78, 80, 82 and 84 are dimensioned such that the free end edges 122 as shown in FIG. 8 (only one shown) of the gripping flaps lie in the substantially same plane as the opposing edges 114 and 116. In such an arrangement, each bottle is supported at the four circumferentially spaced or continuous portions along its flange by the opposing edges 114 and 116 and the associated gripping flaps when the carrier is lifted. In a preferred embodiment, each gripping flap in a flat unfolded condition has a maximum length along the fold line 12 greater than the vertical length "L" of the neck 204 between the lower end of the neck and the underside of the peripheral flange 206 (see FIG. 7).

Figure 10:
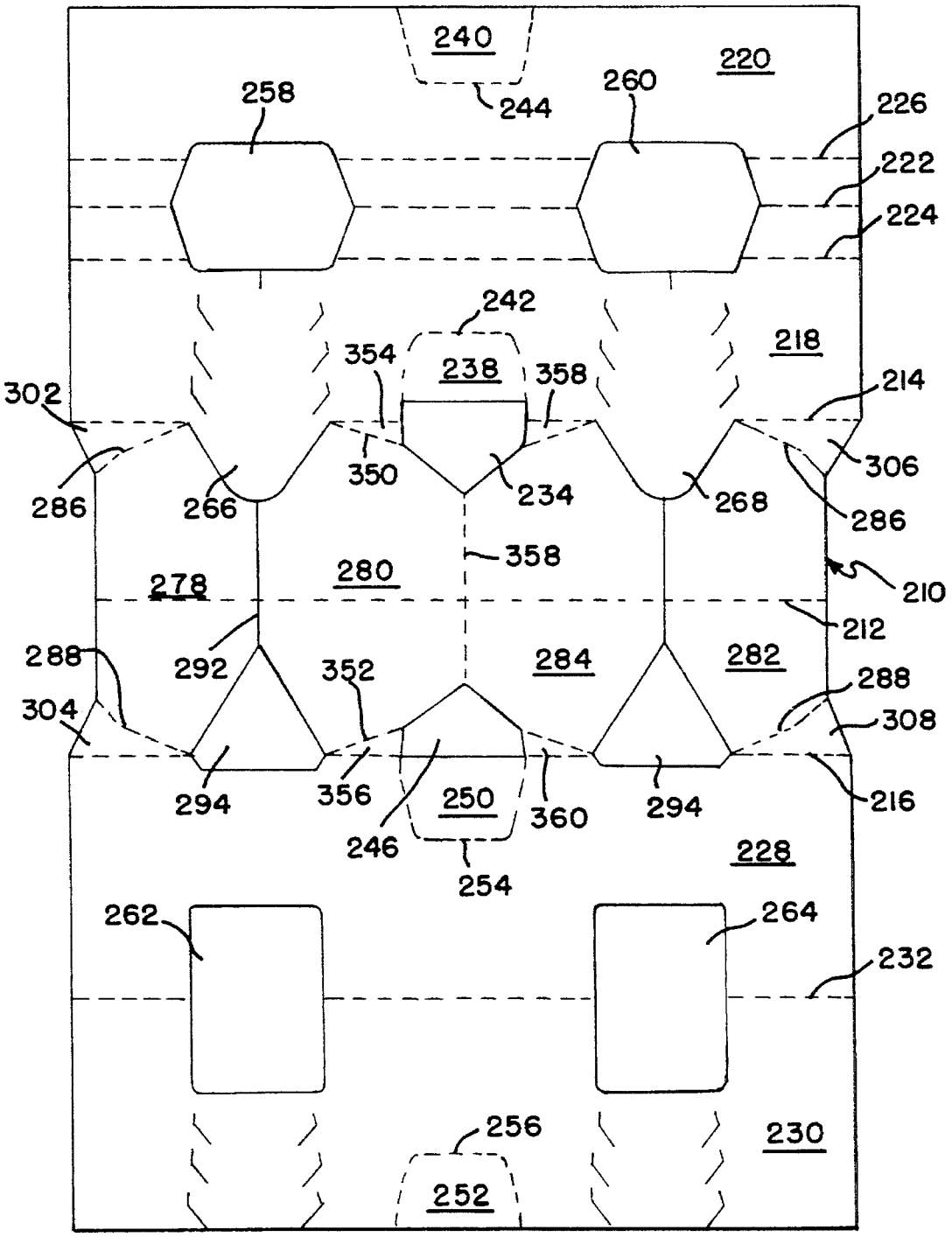
FIG. 10 is a plan view showing a blank of a modified form of the carrier in FIG. 2.
Figure 11:
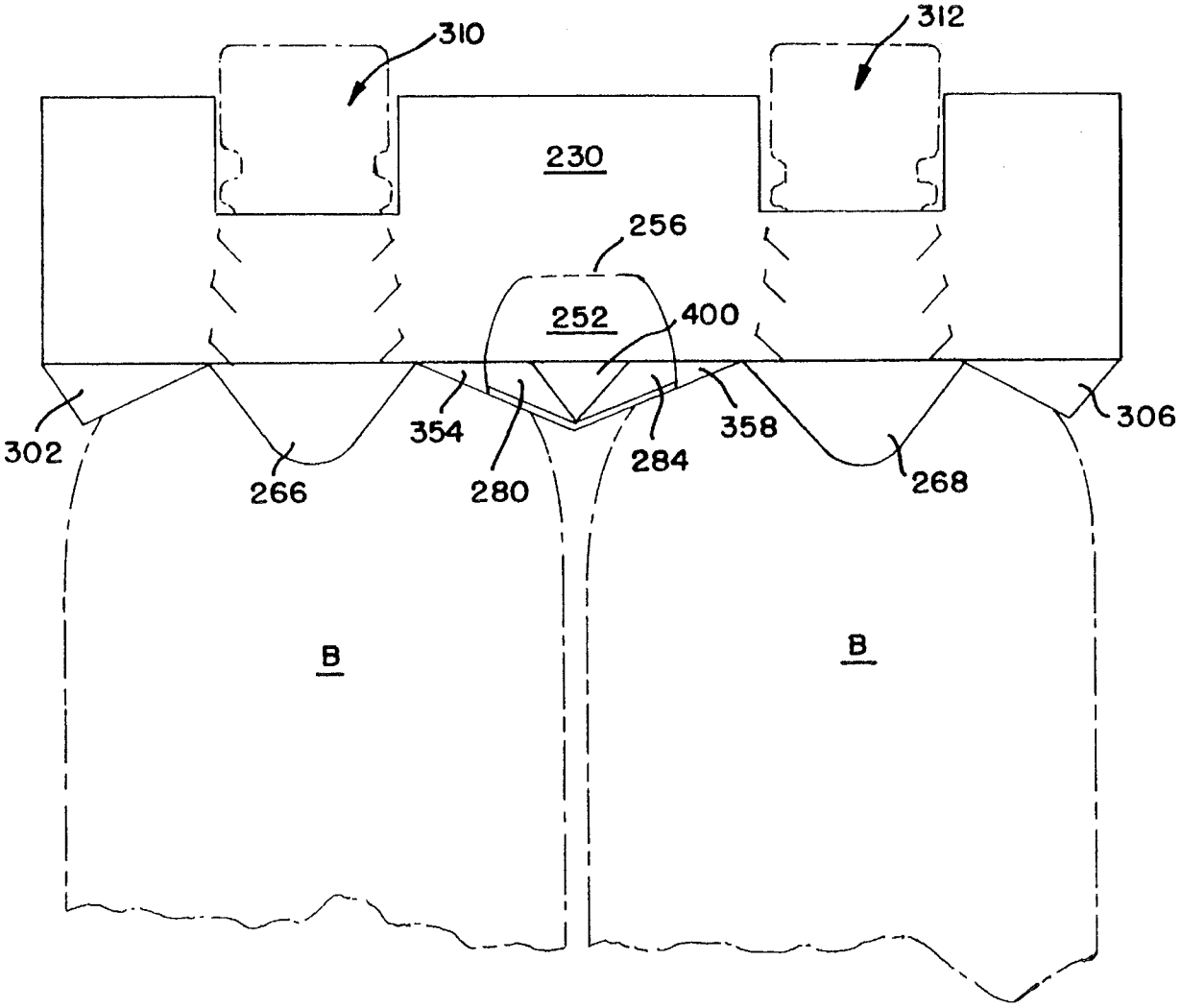
FIG. 11 is a side-elevational view of the carrier in FIG. 10 in a assembled condition.

Illustrated in blank form in FIG. 10 is a modified form of the carrier in FIG. 2, wherein hand/finger apertures are located in close proximity to a base wall 210. More particularly, an aperture 234 is formed in an inner side panel 218 and a base wall 210, and it is disposed astride a fold line 214. A hand-cushioning flaps 238 is foldably joined to the panel 218 along a fold line 242. Likewise, an aperture 246 is formed in an outer side panel 228 and the base wall 210, and it is disposed astride a fold line 216. A hand-cushioning flap 250 is foldably joined to the panel 228 along a fold line 254. A hand-cushioning flap 240 is struck from the portion of an inner side panel 220 adjacent the free side edge thereof and is foldably joined to the panel 220 along a fold line 244. When the flap 240 is folded out of the plane of the panel 220, an aperture is formed in the panel 220, which aperture opens to the free side edge of the panel 220. Likewise, a hand-cushioning flap 252 is struck from the portion of an outer side panel 230 adjacent the free side edge thereof and is foldably joined to the panel 230 along a fold line 256. When the flap 252 is folded out of the plane of the panel 230, an aperture is formed in the panel 230, which aperture opens to the free side edge of the panel 230. When the carrier is set up, the aperture defined by the flap 240 are disposed in substantial registry with the aperture 246 whereas the aperture defined by the flap 252 is disposed in substantial registry with the aperture 234, whereby the hand/finger apertures 400 are provided for the purpose of holding the carrier as shown in FIG. 11 (only one shown). Because the carrier in FIGS. 10 and 11 has its hand apertures located remote from upper apertures 310 and 312, it provides greater structural reliability than the carrier shown in FIGS. 2–9. However, another benefit is also available by locating the hand apertures close to the base wall 210, which will be described later.

The base wall 210 is provided with two pairs of gripping flaps 278, 280, 282 and 284 struck therefrom. The gripping flap 278 of one of the pairs is foldably joined to the base wall 210 along divergent fold lines 286 and 288. Differently from the carrier in FIG. 2, the gripping flap 280 is foldably joined to the base wall 210 along a pair of divergent fold lines 350 and 352. The fold lines 286 and 288 extend from one of the opposite end edges of the base wall 210 to the adjacent side edges 214 and 216 of the base wall 210 respectively so as to diverge from each other in the direction toward the gripping flap 280. The divergent fold lines 350 and 352 extend respectively from the apertures 234 and 246 to the adjacent side edges 214 and 216 of the base wall 210 so as to be divergent from each other toward the flap 278. As a result, substantially triangular panel portions 302, 304, 354 and 356 are defined in the base wall 210, each of which is disposed between the associated one of the divergent fold lines 286, 288, 350 and 352 and the adjacent side edge of the base wall 210. Each of the divergent fold lines 286 and 288 in FIG. 10 is illustrated as an angled line consisting of a plurality of linear fold line elements angularly disposed with respect to each other. However, it may be a straight fold line, instead. The gripping flaps 282 and 284 are virtually identical respectively to the gripping flaps 278 and 280. One feature of the carrier of the invention, however, is that the flaps 280 and 284 are directly joined together along a fold line 358. The remainder of the carrier in FIG. 10 is identical to the carrier in FIG. 2 and thus description thereof is omitted. Those portions in FIG. 10 identical to FIG. 2 are denoted by similar references which are larger by two hundred than the corresponding references used in FIG. 2.

As bottles B are received in the carrier, the gripping flaps 278, 280, 282 and 284 are folded upwardly into the tubular carrier as shown in FIG. 11. While this happens, the triangular panel portions 354, 356, 358 and 360 are inclined downwardly, which provides additional hand/finger room in the hand apertures 400 (only one shown in FIG. 11). This means that the portion of the hand aperture 400 formed in each side wall of the carrier may be of a minimal size for accommodating a finger, which further assures structural strength of the carrier. Other benefits and advantages provided by the carrier in FIG. 10 are virtually equal to those provided by the carrier in FIG. 2.

It will be recognized that many variations may be made to the foregoing within the scope of the present invention. For example, alternate carrier styles may be used, such as those having rectangular tubular structures rather than the triangular tubular structure as shown herein. One such rectangular tubular carrier is shown, for example, in European Patent Application No. 0,048,506 which is hereby incorporated by reference. Further, the carton design may be enhanced through the addition of handle panels, other tear opening features and the like, using structures known and understood within the art. Carriers having handles panels along the ridges of their triangular tubular bodies are shown, for example, in U.S. Pat. Nos. 4,180,191 and 5,273,156 which are hereby incorporated by reference. A carrier having a different type of tear opening feature is shown in U.S. Pat. No. 4,318,476 which is also incorporated by reference.

It should be further recognized that instead of the flanged bottles, bottles with no neck flanges may be used in the invention. In this case, the carrier of the invention is engaged with the lower peripheral edges of the bottle caps.

It should be further recognized that while only one gripping flap of each pair is joined to the base wall 10 along the arched fold line 90 in one of the foregoing embodiments, it may be that both the gripping flaps of each pair are joined along arched fold lines lying concave to each other.

Other modifications may be made in the foregoing without departing from the scope and spirit of the claimed invention.

What is claimed is:

1. A top-gripping bottle carrier for engaging and supporting a bottle at a bottle neck thereof, comprising:

a base wall and a pair of inwardly sloping side walls upstanding respectively from opposite side edges of said base wall to form a triangular tubular structure, said sloping side walls being foldably joined at upper edges thereof together along a ridge extending parallel to a tube axis of said tubular structure, said side walls having a first aperture for receiving a neck flange at said neck of a bottle, said base wall having a second disposed in vertical alignment with said first aperture to receive a lower neck portion of said bottle; first neck-gripping means for gripping said bottle neck at under said neck flange thereof, said first gripping means comprising a pair of engaging edges defining in said side walls said first aperture, said engaging edges being provided respectively by said side walls, being opposed transversely of said tube axis and extending substantially parallel to said tube axis; and means for pivoting said side walls toward each other about said ridge in response to introduction of said bottle into said second aperture so that said engaging edges are forced toward each other to be tightened on said bottle neck.

2. The carrier according to claim 1, wherein said pivoting means comprises a pair of opposing flaps struck solely from said base wall and defining in said base wall said second aperture, each of said flaps having joint means for foldably joining said each flap to said base wall, said joint means of at least one of said flaps being a pair of divergent fold lines which extend divergently from each other toward the other flap.

3. The carrier according to claim 2, wherein said pivoting means further comprises a pair of triangular panel portions each connecting between said at least one flap and adjacent one of said side walls, said each triangular panel portion being formed from said base wall and being foldably joined to a lower edge of said adjacent side wall and to said at least one flap along adjacent one of said divergent fold lines, said triangular panel portions being folded outwardly of said tubular structure about said lower edges of said side walls when said at least one flap is folded inwardly of said tubular structure along said divergent fold lines.

4. The carrier according to claim 3, wherein said divergent fold lines of said at least one flap extend divergently from each other toward one of open ends of said tubular structure and is disposed angularly with respect to said tube axis of said tubular structure.

5. The carrier according to claim 4, further comprising second-neck gripping means for gripping said bottle neck at under said neck flange thereof, said second neck-gripping means comprising free end edges of said opposing flaps, said free end edges being disposed in a plane no higher than said engaging edges of said first aperture when said flaps are folded inwardly of said tubular structure.

6. The carrier according to claim 1, wherein said pivoting means comprises a pair of opposing flaps struck solely from said base wall and defining said second aperture, each of said flaps having joint means for foldably joining said each flap to said base wall, said joint means of at least one of said flaps comprising a substantially arched fold line which lies concave to the other flap, said at least one flap being thrust aside and folded inwardly of said tubular structure along said arched fold line when said bottle is introduced into said second aperture such that a portion of said base wall along said arched fold line is bowed outwardly of said tubular structure.

7. The carrier according to claim 6, wherein said opposing flaps extend from said base wall to respective upper edges, said upper edges of said flaps being disposed under said neck flange of said bottle.

8. A top-gripping bottle carrier for engaging and supporting a bottle at a bottle neck thereof, comprising:

a base wall having a bottle neck-receiving aperture;

a pair of side walls upstanding respectively from opposite side edges of said base wall, said side walls being foldably joined at lower edges thereof to said base wall, said side walls being provided respectively with hand apertures, each of said hand apertures being disposed astride said lower edge of respective one of said side walls and extending into said base wall; and means for downwardly displacing a part of said base wall relative to said side walls in response to introduction of a bottle neck into said neck-receiving aperture such that the vertical size of said each hand aperture is increased to provide additional hand room whereby a portion of said each hand aperture in said respective side wall can be of a minimal size for accommodating a finger.

9. The carrier according to claim 8, wherein said downwardly displacing means comprises a flap struck from said base wall so as to define said neck-receiving aperture, said flap being foldably joined along opposite side edges thereof respectively to a pair of triangular panel portions of said base wall, said triangular panel portions being foldably joined respectively to said side walls and defining respective edges of said hand apertures whereby when a bottle neck is introduced into said neck-receiving aperture, said flap is thrust aside to downwardly fold said triangular panel portions relative to said side walls.

* * * * *